United States Patent [19]

Farfalli

[11] Patent Number: 4,759,238

[45] Date of Patent: Jul. 26, 1988

[54] POCKET CORKSCREW

[75] Inventor: Germano Farfalli, Maniago, Italy

[73] Assignee: Marino Farfalli & Figli s.n.c., Maniago, Italy

[21] Appl. No.: 33,764

[22] Filed: Apr. 3, 1987

[30] Foreign Application Priority Data

Nov. 17, 1986 [IT] Italy ..... 45751 A/86

[51] Int. Cl.[4] ..... B67B 7/44

[52] U.S. Cl. ..... 81/3.09; 7/154; 81/3.35

[58] Field of Search ..... 81/3.07, 3.09, 3.36, 81/3.45, 3.55, 3.35; 7/154, 151

[56] References Cited

U.S. PATENT DOCUMENTS 4,580,303 4/1986 Henshaw ..... 81/3.45

4,584,911 4/1986 Cellini ..... 81/3.09

FOREIGN PATENT DOCUMENTS 97766 1/1940 Sweden ..... 7/154

*Primary Examiner*—Roscoe V. Parker

*Attorney, Agent, or Firm*—Scrivener and Clarke

[57] ABSTRACT

Corkscrew of the type having folding tools (2,3) in a handle (4), such as a screw-type means of insertion in a cork (2) and a fulcrum lever extension means such as counter-lever (3) having a slot seat for crown caps as well, and the additional function of supporting by a notched end on the inside ledge of the bottle's neck together with said means of screw insertion (2), both hinged to one end of the handle at a convenient distance from each other, characterized in that:

the handle (4) is in plastic material, and the fulcrum lever extension means such as counter-lever (3) is of a semitubular form having a slot seat (3″) through its back with an undercut to engage a crown cap, and the handle (4) being equipped with a hollow complementary with the slot so as to make it actively usable whether the counter-lever is closed or is completely open in alignment, or nearly so, with the handle (4).

3 Claims, 1 Drawing Sheet

POCKET CORKSCREW

Figure 1:
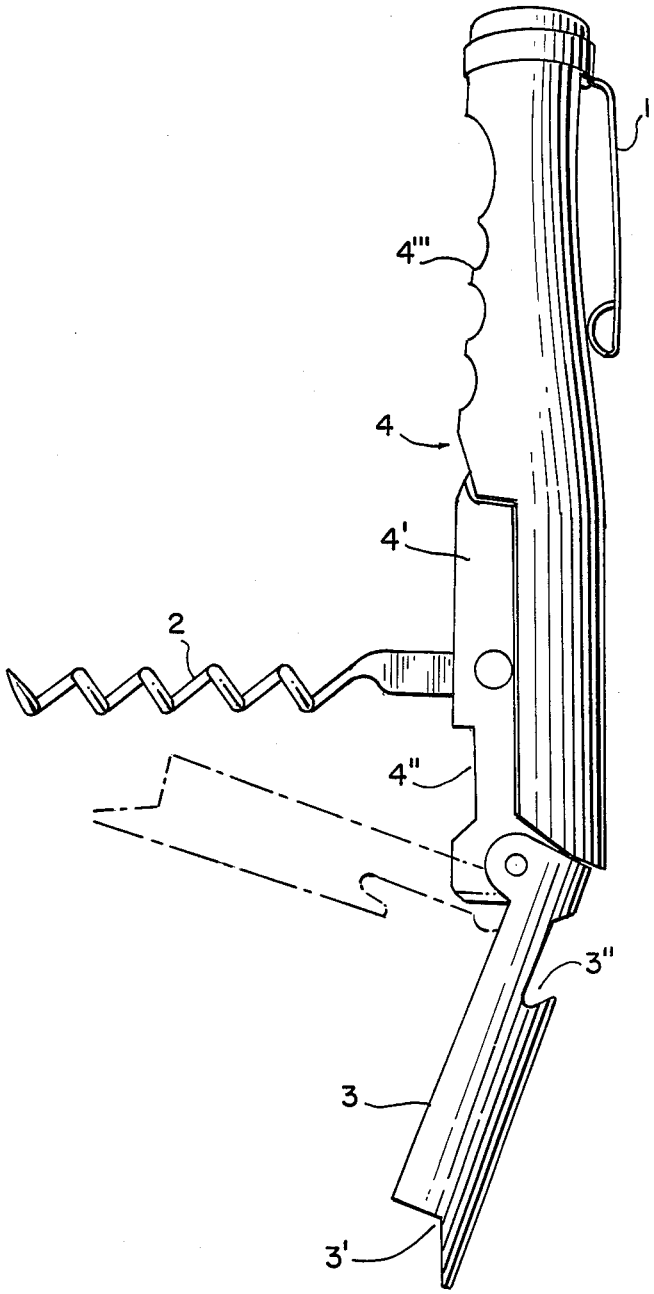

The present invention relates to pocket corkscrews and more particularly to an improved pocket corkscrew adapted to remove corks and also crown caps from bottles.

Several types of pocket corkscrews are known at the present state of art with respective tools which fold into the handle. They are generally equipped with a helically-twisted gimlet and a lever extension which acts as a supporting counterlever, both of which are hinged to the handle at a convenient distance from each other at one end of the handle, the gimlet being adapted to be screwed into a cork to be extracted, and the supporting lever extension to be rested on the neck of the bottle to provide a fulcrum for the lever. The counterlever conveniently carries means enabling the removal of so-called "crown" caps.

It is also known that these types of pocket corkscrews must necessarily be of metal to provide the required sturdiness for the extraction of corks which frequently require considerable force. It is also known that metal means corkscrews have high production costs due not only to the working of the metal but also to its necessary coating by successive chromium plating. Lastly, it is known that because of frequent use, even the best quality coatings deteriorate due to sweat from contact with the hand and quickly become oxidated and unsightly. On the other hand, metals which are of better quality than steel (e.g. brass) do not and the use of fine quality metals such as stainless steel would make the tool prohibitively expensive. Furthermore, the means for removing crown caps is frequently found to be ineffective and bends easily under elevated stress upon the removal of crown caps which are particularly resistant.

Finally, these tools do not have a suitable means of attachment so as to be kept in an easy and practical way in the pocket, as they are frequently used by restaurant waiters.

The object the present invention is to eliminate the above-mentioned inconveniences.

The present invention solves the foregoing problems of a pocket corkscrew of the type having tools which fold into the handle, these tools being a screw-type means for insertion into a cork and a fulcrum lever extension means such as a counterlever which includes means for the removal of crown caps, and the additional function of supporting by a notched end engageable with the inside ledge of a bottle neck to provide a fulcrum for the screw-type means of insertion, the counter lever and screw-type means being both hinged to an end of the handle at a convenient distance from each other, characterized by the fact that:

the handle is of plastic material, and the counter lever is of a semi-tubular shape having a slot seat through its back provided with an undercut to engage a crown cap; the handle being equipped with a hollow complementary with the slot seat so that it is actively usable for removing crown caps whether the counterlever is closed or completely open and in alignment, or nearly so, with the handle. With this solution there are no degradation problems as the body is of plastic material; the article is very light, and gives maximum functionality as the tools are of metal and have maximum sturdiness.

Furthermore, by locating the slot seat for the crown caps so that it extends through the back of the counterlever instead of being located inside the lever, movement of the lever during cap removal is easier and more comfortable as one can work either with counter lever closed if only negligible force is required to remove a cap, or with the counterlever open if maximum force is required. In the second case one obviously uses the counterlever as a lever extension.

The inventions includes a pocket clip, such as used on writing pens, on the opposite end of the handle which permits the corkscrew to be clipped into a pocket for ready use when necessary. This is particularly useful for waiters.

Figure 2:
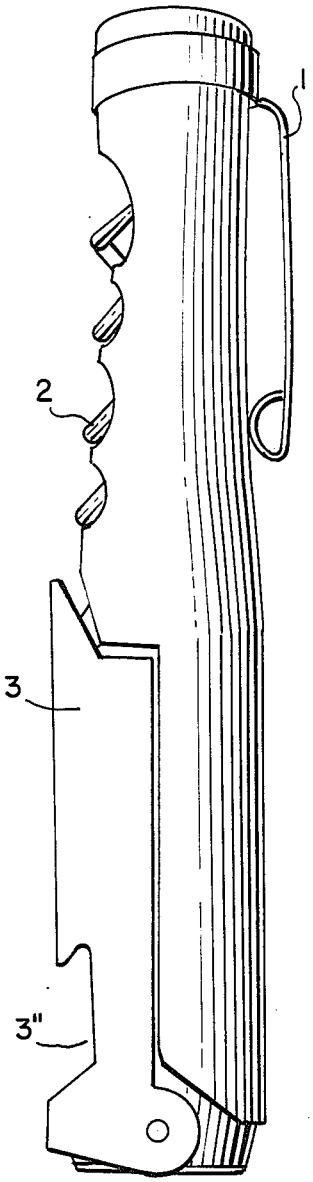

The invention is hereafter described in more detail in conjunction with the accompanying drawings showing a preferred embodiment of the invention, the details of which are not to be held as limiting but only as examples wherein FIG. 1 is a side elevational view of the opener with the respective tools open; and FIG. 2 is a view similar to FIG. 1 with the respective tools closed.

As can be seen from the above-mentioned figures, the invention comprises a pocket corkscrew of the type having folding tools (2,3) in a handle (4), these being a screw-type means (2) for insertion into a a cork and a fulcrum lever extension such as the counter lever (3) having a slot seat 3" through its back for removing crown caps as well as providing the additional function of supporting by its notched end (3') the tool on the inside ledge of a bottle neck during removal of a cork following insertion of the screw-type means (2) therein. Both the counter lever (3) and the screw-type means (2) are hinged at one end of handle (4) and at a convenient distance from each other.

The handle (4) is of plastic material. The counter lever (3) is of semitubular shape, having the slot seat 3 through its back, one side of the slot seat being undercut to receive a crown cap, the handle (4) being equipped with a corresponding hollow (4") complementary with the slot seat when the counter lever is in its closed position of FIG. 2 whereby the counter lever is actively usable for removing crown caps whether it is closed or completely open and in alignment, or nearly so, with the handle (4) as in FIG. 1.

It will be noted that a pocket clip (1) is arranged at the opposite end of the handle.

It will be further noted that the handle presents an elongated bottleneck shape with a recessed seats for the respective tools, and in particular, the extraction screw seats means in the recess (4"") in the neck and the counterlever (3) seats in a recess (4') when closed, the lever being of a size that when closed it maintains the same circumferential diameter of said handle by partially covering the extraction screw means (2).

The details of the invention may naturally be varied without departing from the scope and spirit of the attached claims.

I claim:

1. Pocket corkscrew, of the type having folding tools (2,3) in a handle (4), said tools comprising a screw-type means for insertion into a cork (2) and a fulcrum lever extension means such as the counter lever (3) including means for removing crown caps both said tools being hinged to one end of the handle at a convenient distance from each other, characterized in that:

said handle (4) is of plastic material, and said fulcrum lever extension means such as counter lever (3) is of semitubular form having a slot seat (3″) cut through its back with an undercut to receive a crown cap and said handle (4) is equipped with a complementary hollow for said slot seat so as to render the latter actively usable for removing crown caps both when the counterlever is closed and when it is completely open in alignment, or nearly so, with the handle (4).

2. Pocket corkscrew, as in claim 1, characterized in that said handle (4) includes a pen-type pocket clip at its other end.

3. Pocket corkscrew, as in claim 1, characterized in that said handle presents an elongated bottleneck shape with recessed seats for said tools and, in particular, the screw-type means seats in the recess (4‴) in the neck and said counter-lever (3) seats in a recess (4′) when closed, said lever being of a size then when closed it maintains the same circumferential diameter of said handle by partially covering said screw (2).

* * * * *